US009174232B2

(12) United States Patent
Su et al.

(10) Patent No.: US 9,174,232 B2
(45) Date of Patent: Nov. 3, 2015

(54) WATER SPRAY GUN

(71) Applicant: Ningbo Daye Garden Industrial Co., Ltd., Yuyao (CN)

(72) Inventors: Ke Su, Yuyao (CN); Xiaodong Ye, Yuyao (CN); Qingxin Liu, Yuyao (CN)

(73) Assignee: NINGBO DAYE GARDEN SCIENCE COMPANY, Yuyao (CN)

( * ) Notice: Subject to any disclaimer, the term of this patent is extended or adjusted under 35 U.S.C. 154(b) by 38 days.

(21) Appl. No.: 14/242,833

(22) Filed: Apr. 1, 2014

(65) Prior Publication Data

US 2015/0034740 A1 Feb. 5, 2015

(30) Foreign Application Priority Data

Aug. 1, 2013 (CN) ..... 2013 1 0334055

(51) Int. Cl.

| | |
|---|---|
| ***B05B 1/30*** | (2006.01) |
| ***B05B 9/01*** | (2006.01) |
| ***B05B 12/00*** | (2006.01) |
| *B05B 1/14* | (2006.01) |
| *B05B 1/16* | (2006.01) |

(52) U.S. Cl.

CPC ..... *B05B 9/01* (2013.01); *B05B 1/3013* (2013.01); *B05B 12/002* (2013.01); *B05B 1/14* (2013.01); *B05B 1/16* (2013.01)

(58) Field of Classification Search

CPC ..... B05B 1/3013; B05B 9/01; B05B 12/002

See application file for complete search history.

(56) References Cited

U.S. PATENT DOCUMENTS

| | | | | |
|---|---|---|---|---|
| 6,454,187 | B1 * | 9/2002 | Wang | 239/526 |
| 6,641,061 | B1 * | 11/2003 | Hsieh | 239/526 |
| 2007/0080242 | A1 * | 4/2007 | Wang et al. | 239/526 |
| 2012/0061490 | A1 * | 3/2012 | Chung | 239/526 |

* cited by examiner

*Primary Examiner* — Ryan Reis

(74) *Attorney, Agent, or Firm* — Matthias Scholl P.C.; Matthias Scholl

(57) ABSTRACT

A water spray gun including a gun body. The gun body includes: an inner part including a water channel; an outer part including a handle; an upper part including a spray bar, a water spray plate, a lock button, and a pull rod including a plug; and a lower part including an water stop plug disposed at an distal end thereof, a water stop plate, a water stop spring, a first sealing ring for stopping water, and a second sealing ring for introducing water. The water channel is disposed in the inner part of the gun body. The handle is movably mounted on the outer part of the gun body via a pin. A water sealing position of the water spray gun is disposed at the distal end for keeping the water out of the gun body and for preventing the gun body from becoming stuck and rupturing.

10 Claims, 21 Drawing Sheets

WATER SPRAY GUN

CROSS-REFERENCE TO RELATED APPLICATIONS

Pursuant to 35 U.S.C. §119 and the Paris Convention Treaty, this application claims the benefit of Chinese Patent Application No. 201310334055.1 filed Aug. 1, 2013, the contents of which are incorporated herein by reference. Inquiries from the public to applicants or assignees concerning this document or the related applications should be directed to: Matthias Scholl P.C., Attn.: Dr. Matthias Scholl Esq., 14781 Memorial Drive, Suite 1319, Houston, Tex. 77079.

BACKGROUND OF THE INVENTION

1. Field of the Invention

The invention relates to a water spray gun.

2. Description of the Related Art

A typical water spray gun generally includes: a handle, and an elastic top plug. Working principle of the water spray gun is as follows: the water is sprayed out when pressing the handle, and the top plug is reset and sealed under the force of the spring. In one respect, such a water spray gun brings in inconvenience in use. The user must continuously press the handle of the water spray gun to allow a continuous water jet to be sprayed out, which easily makes the user feel tired after long-term use. Thus, a lock button having a revolving shaft 10 is designed on the water spray gun for tackling the above problem. However, the operation of the lock button is inconvenient. When the right hand holds the water spray gun, the user must use fingers and nails of the left hand to turn on the lock button and make the lock button revolve for a relatively large angle and be stably fixed in an inner part of an upper edge of the handle. Also, the arrangement of the lock button is very close to the gun body, therefore, the lock button is slippery during the operation thereof using wet fingers. In another respect, the conventional gun bodies generally have the anti-freezing problems. As the water sealing position of the conventional water spray gun is disposed close to the plug, and water residue remains inside the gun body, the gun body is easy to be frozen and ruptured in cold weather when the water spray gun is in the nonuse state. Even different means have been tried including adopting a strengthened gun body and fitting with a plastic protecting boot, these means are not practicable.

SUMMARY OF THE INVENTION

In view of the above-described problems, it is one objective of the invention to provide an anti-freezing water spray gun having a water sealing position at a distal end thereof.

An anti-freezing water spray gun having a water sealing position at a distal end, the water gun comprises a gun body, the gun body comprising: an inner part, the inner part comprising a water channel; an outer part, the outer part comprising a handle; an upper part, the upper part comprising a spray bar, a water spray plate, a lock button, and a pull rod comprising a plug; and a lower part, the lower part comprising an water stop plug disposed at an distal end thereof, a water stop plate, a water stop spring, a first sealing ring for stopping water, and a second sealing ring for introducing water. The water channel is disposed in the inner part of the gun body. The handle is movably mounted on the outer part of the gun body via a pin. In conventional water spray gun, the water sealing position is disposed near the position of the plug, and water residues still remains in the gun body, which results freezing or even rupture of the gun body. However, the water spray gun of the invention is capable of sealing the water at a water sealing position of the distal end for keeping the water out of the gun body and for preventing the gun body from being frozen and ruptured after the water spray gun being closed. The pull rod is pulled backward when the handle is pressed down, the water stop plug moves downwardly under the force of the plug and drives the second sealing ring for introducing water to move outward to allow the water spray gun to stay at an open state. The water enters the gun body and is sprayed out via the spray bar and the water spray plate. The handle is pressed by the lock button for continuously spraying water. The pull rod is reset under the force of the spring when the handle is released and the water stop plug is reset under the force of the water stop spring, the first sealing ring for stopping water is driven to move forward, the water is sealed outside the gun body, and the water spray gun is at a closed state for keeping the water outside thereof. The plug and the water stop plug of the distal end cooperate when the water spray gun is closed to allow the water stop plate and the first sealing ring for stopping water to seal the water at the distal end for keeping the water out of the gun body and preventing the gun body from being frozen and ruptured.

In a class of this embodiment, the plug of the pull rod is in the shape of a cone. The plug comprises: a front circle comprising a plurality of teeth for allowing the water to flow out, and a conical head being connected to the pull rod. A generating line of a curved surface of the cone of the plug is an equiangular spiral featuring in equivalent pressure angles, that is, logarithmic spiral. An equiangular spiral surface of the plug is capable of stably matching with a push head arranged on an upper part of the water stop plug of the distal end.

In the above technical solution, the generating line of the curved surface of the cone of the plug is the equiangular spiral featuring in equivalent pressure angles, that is, the logarithmic spiral. A section of a main body of the pull rod is selected, and a differential equation $d\rho/d\theta=k\rho$ is constructed as follows: a polar coordinates equation $\rho=\rho(\theta)$ is defined, as the pressure angle $\lambda$, is desired to be equivalent everywhere, $tg\lambda$ is evaluated with a constant value, and herein $tg\lambda=k$. According to the equation of the pressure angle $tg\lambda=\rho'/\rho$, $\rho'/\rho=k$ is derived. A differential equation $d\rho/d\theta=k\rho$ is derived by differential calculus.

To solve the differential equation $d\rho/d\theta=k\rho$, the variables are separated and integral calculus are performed on both sides of the equation: $\int d\rho/\rho=\int k d\theta$, since $\rho>0$, $\ln \rho=k\theta+C$ is obtained, that is, an exponential equation is $\rho=Ae^{k\theta+C}=e^{C}$, and $e^{k\theta}=Ae^{k\theta}$.

Drawing software PRO/ENGINEER WILDFIRE is adopted. A new working directory is started, and new components are constructed.

PARAMETER 1 is constructed: C is a real number and is a default assignment;

PARAMETER 2 is constructed: N is an integer and is a default assignment; and

Relations are constructed, and the equations of the invention are as follows: a logarithmic curve: z=0; x=10*t; and y=log(10*t+0.0001). The logarithmic curve is then drawn.

After that, a model is constructed by using instructions comprising revolution, merger, and materialization, and by performing work piece assembly and combination.

The equations and the model constructed by PRO/ENGINEER WILDFIRE are input into a CNC machining center, CIMATRO or MASTCAM are used to press a steel model for casting aluminum alloy, or a milling machine, facing machine, are an electric spark machining are used auxiliarily.

When the electric spark machining is used, the equations are input into the CNC machining center. A tungsten copper electrode is required to be prepared, an ideal machine used herein is provided with three-dimensional rotating heads, for example, a Charmilles machine made in Sweden is preferred. After that, a cold chamber die casting machine or a hot chamber die casting machine is used for batch production, followed with machine work. Most workpiece are made of ZL109 or AC8A aluminum alloy and are polished. As the generating line of the curved surface of the cone of the plug is a part of the equiangular spiral featuring in equivalent pressure angles, that is, the logarithmic spiral, the equiangular spiral surface of the plug is capable of stably matching with the push head arranged on the upper part of the water stop plug of the distal end.

In a class of this embodiment, a seal groove is disposed at a lower part of the water stop plug of the distal end for fitting with the first sealing ring for stopping water.

In a class of this embodiment, four deflection strips are arranged at a lower part of the water stop plug of the distal end and uniformly surround an axis of a reciprocating direction of the water stop plug. A curve line of each of the four deflection strips is a deflection curve satisfying a deflection curve equation concerning a load density q and a bending stiffness EJ in mechanics of materials.

In a class of this embodiment, an oblique limiting piece is arranged at an upper part of the water stop plug, an included angle between the oblique limiting piece and an axis of a reciprocating direction of the upper part of the water stop plug is between 30° and 80° for limiting a position thereof.

In a class of this embodiment, a push head is arranged at an upper part of the water stop plug for matching with the plug of the pull rod.

In a class of this embodiment, two curved plates are symmetrically disposed inside the water stop plate for matching with the water stop spring and four deflection strips arranged at a lower part of the water stop plug of the distal end. A positioning ring in the shape of an ellipse is disposed at an outer part of the water stop plate for preventing rotation. Through holes are arranged in the water stop plate for matching with the first sealing ring for stopping water.

In a class of this embodiment, the lock button is in movable rivet connection with the gun body for locking the handle during water spraying. A rivet hole of the lock button is provided with convex-concave knurls for preventing looseness. The lock button is provided with a recess for preventing a finger from slipping from the lock button.

In a class of this embodiment, the water spray plate is provided with a plurality of triangular holes. The triangular holes are arranged in three concentric circles, and conic holes are arranged among the concentric circles.

In a class of this embodiment, three convex pieces are disposed on an outer ring of the second sealing ring for introducing water at different horizontal planes. The arrangement of the three convex pieces is in accordance with a helicoidal surface of a water inlet thread for attenuating a twisted stress and ensuring a sealing property.

Advantages of the invention are summarized as follows:

First, the lock button is in movable rivet connection with the gun body for locking the handle during water spraying. The rivet hole of the lock button is provided with convex-concave knurls for preventing looseness. The lock button is provided with the recess for preventing the finger from slipping from the lock button. Thus, the structure of the water spray gun of the invention is very convenient.

Second, when the handle is released, the pull rod is reset under the force of the spring and the water stop plug is reset under the force of the water stop spring, the first sealing ring for stopping water is driven to move forward, the water is sealed outside the gun body, and the water spray gun is at the closed state for keeping the water outside thereof. The plug and the water stop plug of the distal end cooperate when the water spray gun is closed to allow the water stop plate and the first sealing ring for stopping water to seal the water at the distal end for keeping the water out of the gun body and preventing the gun body from being frozen and ruptured. The plug comprises: the front circle comprising the teeth for allowing the water to flow out, and the conical head being connected to the pull rod. The generating line of the curved surface of the cone of the plug is the equiangular spiral featuring in equivalent pressure angles, that is, logarithmic spiral. Thus, the equiangular spiral surface of the plug is capable of stably matching with the push head arranged on the upper part of the water stop plug of the distal end. The water spray gun of the invention solves the problem in conventional water spray guns that the water sealing position is disposed near the plug and water residue remains in the gun body when the water spray gun is closed, which easily results in freezing and rupture of the water spray gun.

Third, the water spray plate is provided with the triangular holes arranged in three concentric circles, and conic holes are arranged among the concentric circles. The spray bar comprises a guide surface and oblate nozzles. In spraying the water, the spray bar slightly trembles under the combined force of the guide surface, the plug, and the water jet. The water is sprayed out of the spray bar via the oblate nozzles arranged on the spray bar, and is sprayed out via the spray head of the spray bar and the triangular holes and the conic holes arranged on the spray plate, so that the pattern of the sprayed water is diversified.

Fourth, the conventional second sealing ring for introducing water is made of rubber and generally comprises three convex pieces arranged in the common horizontal plane, however, as the workpiece mounted thereon is provided with threads having a pitch, a helix angle, and a lead, so that when the conventional second sealing ring for introducing water comprising three convex pieces arranged on the common horizontal plane is mounted on the thread, the twisted internal stress is produced, thereby affecting the sealing property of the inner ring of the sealing ring. To solve the problem, the three convex pieces of the invention is arranged in accordance with the pitch of the thread. For example, if the pitch is equal to 1.5, then the height of each convex piece is increased by 0.5. As the three convex pieces of the outer ring of the second sealing ring for introducing water are distributed at different heights according to the water inlet thread, the twisted stress is decreased and the sealing property is ensured.

Figure 1:
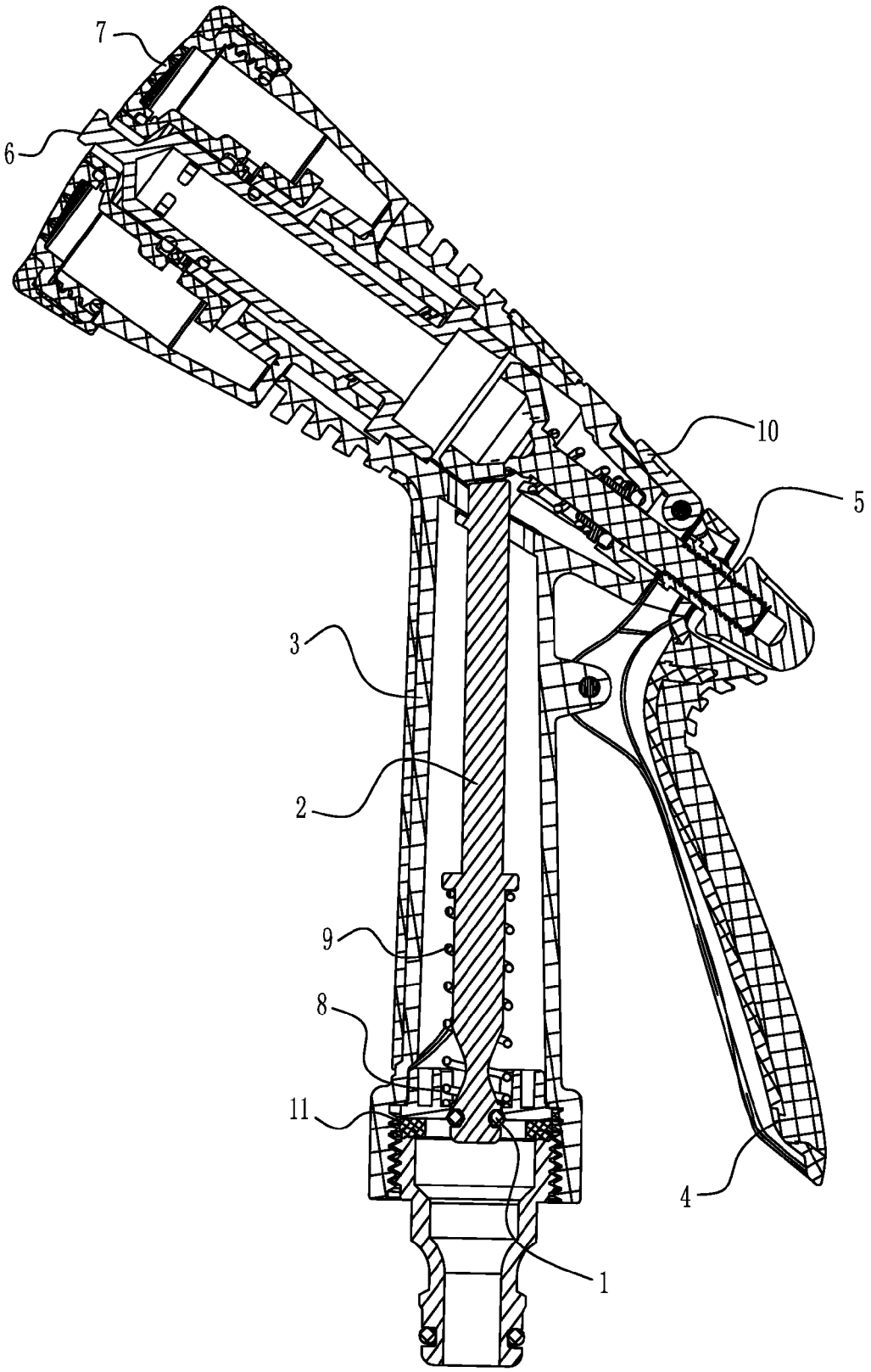
FIG. 1 is a cross-section view of an inner part of an anti-freezing water spray gun having a water sealing position at a distal end when the water is sealed at a distal end.
Figure 2:
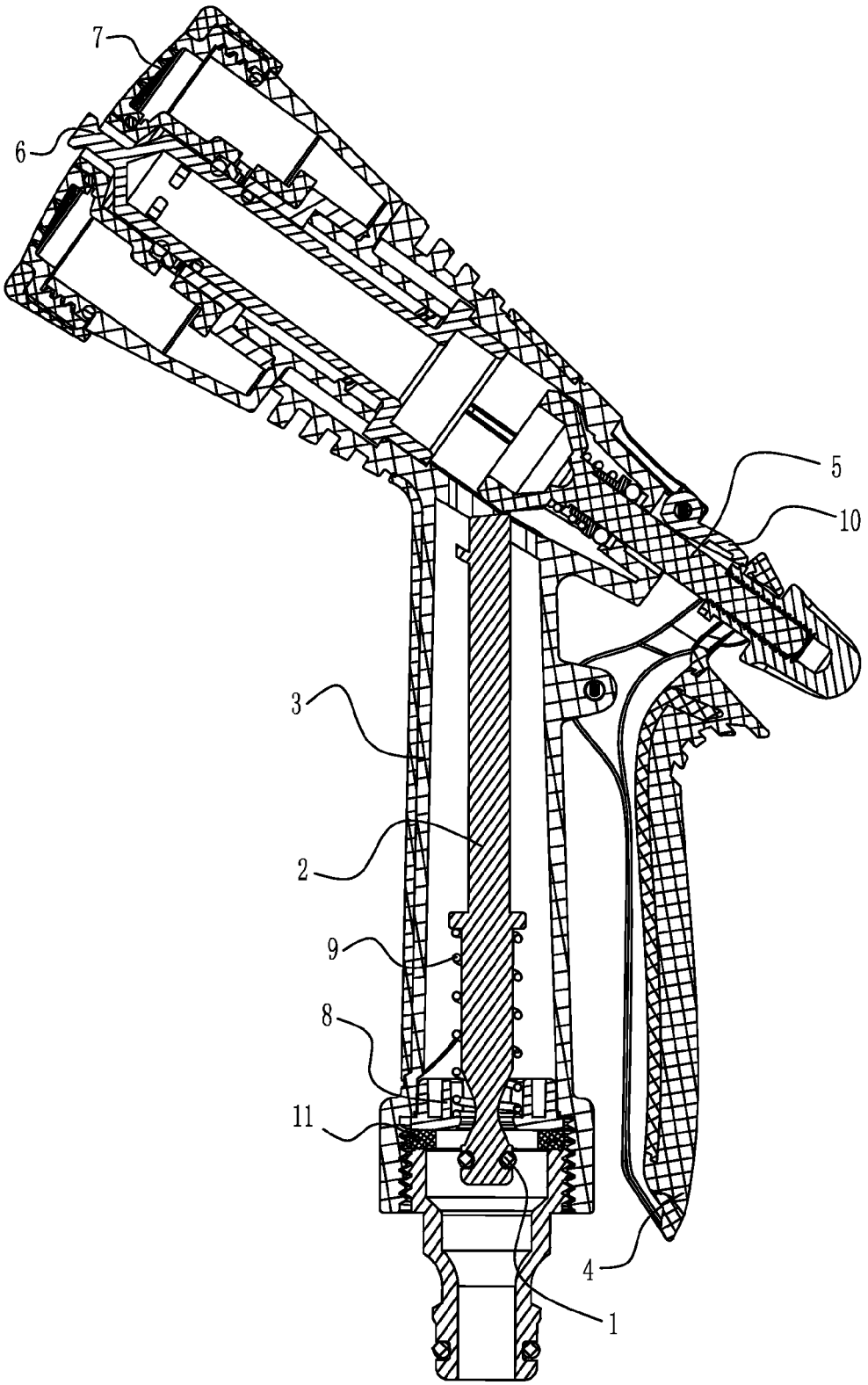
FIG. 2 is a cross-section view of an inner part of an anti-freezing water spray gun having a water sealing position at a distal end when the water is not sealed at a distal end.
Figure 3:
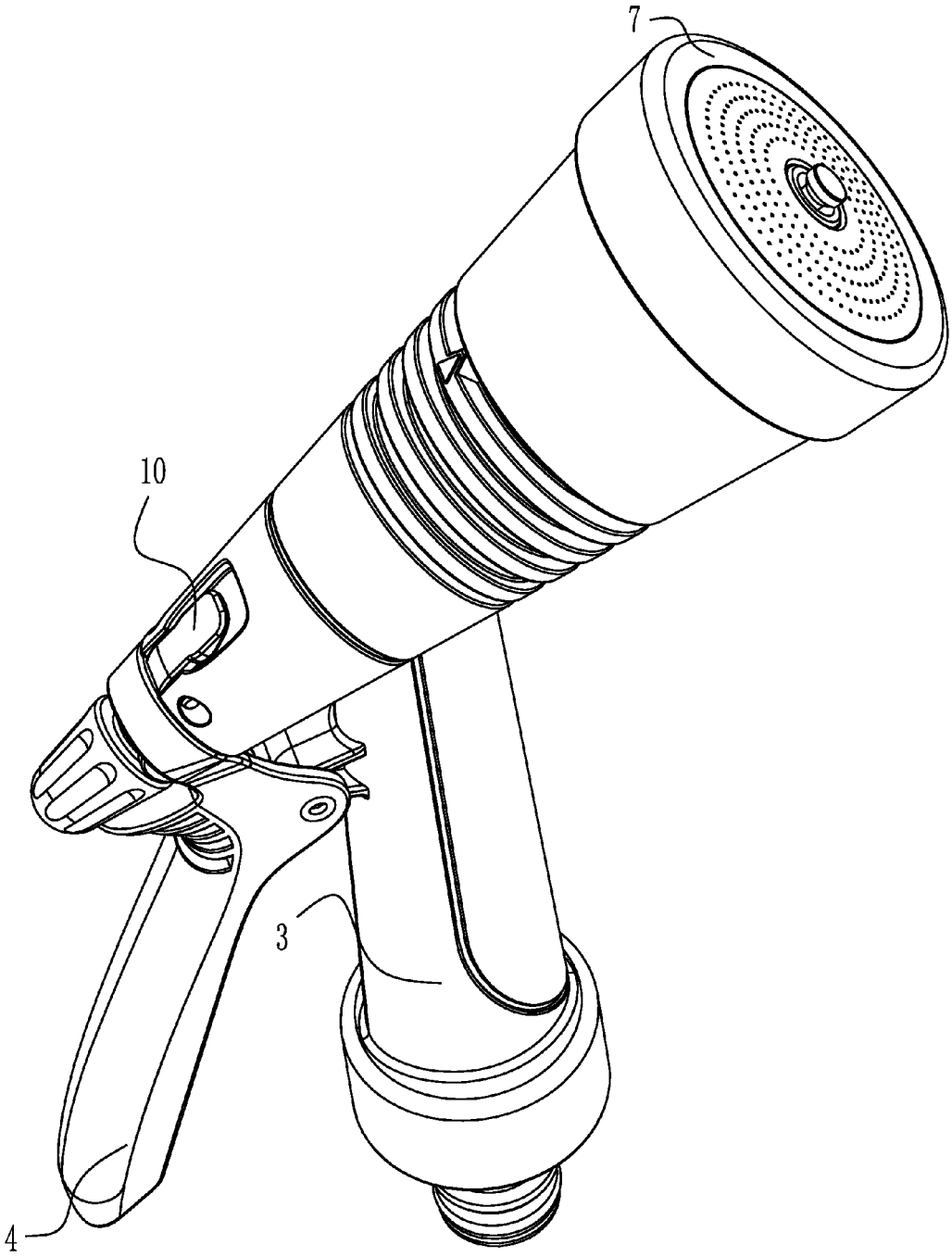
FIG. 3 is a first stereogram of an anti-freezing water spray gun having a water sealing position at a distal end.
Figure 4:
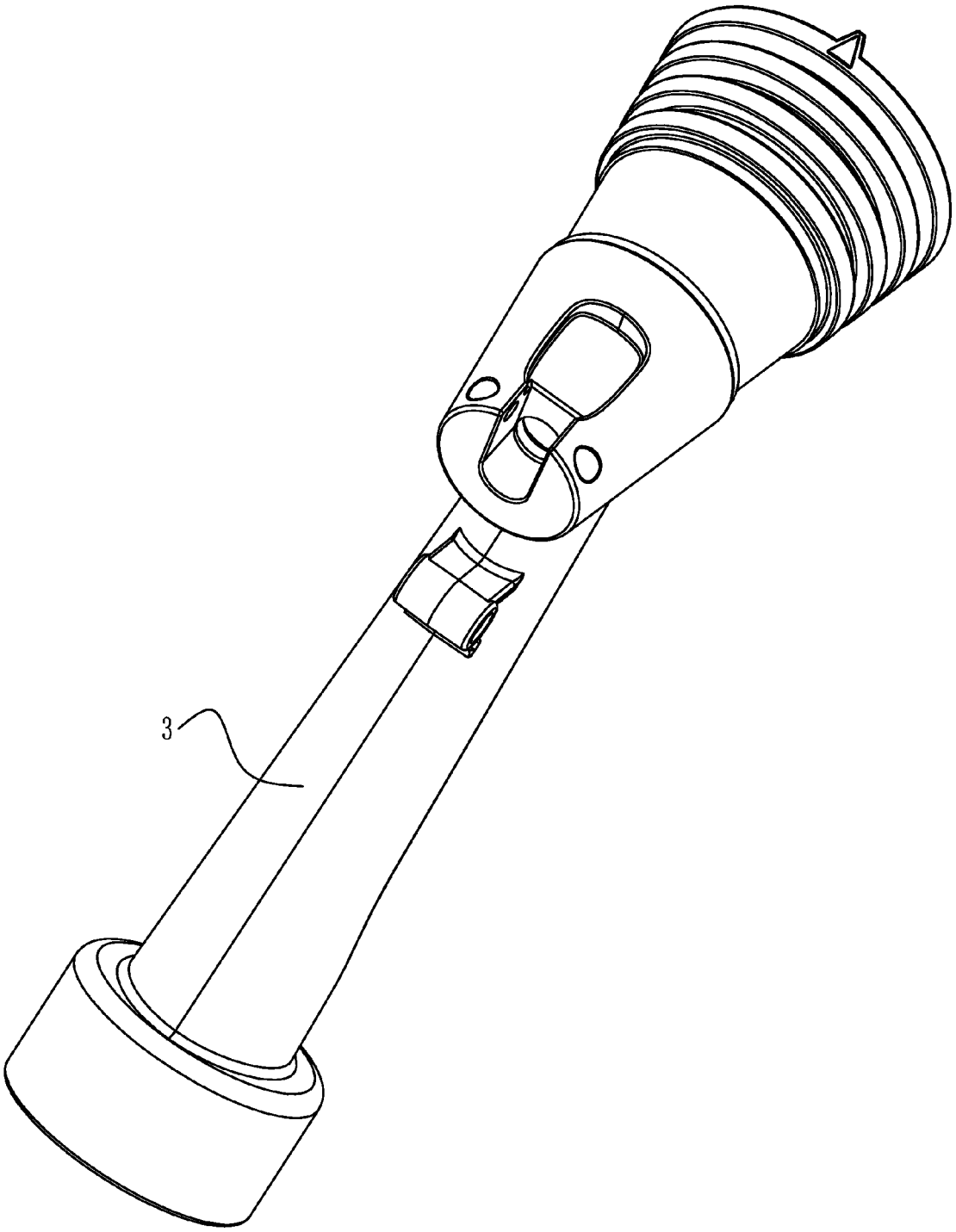
FIG. 4 is a second stereogram of an anti-freezing water spray gun having a water sealing position at a distal end.
Figure 5:
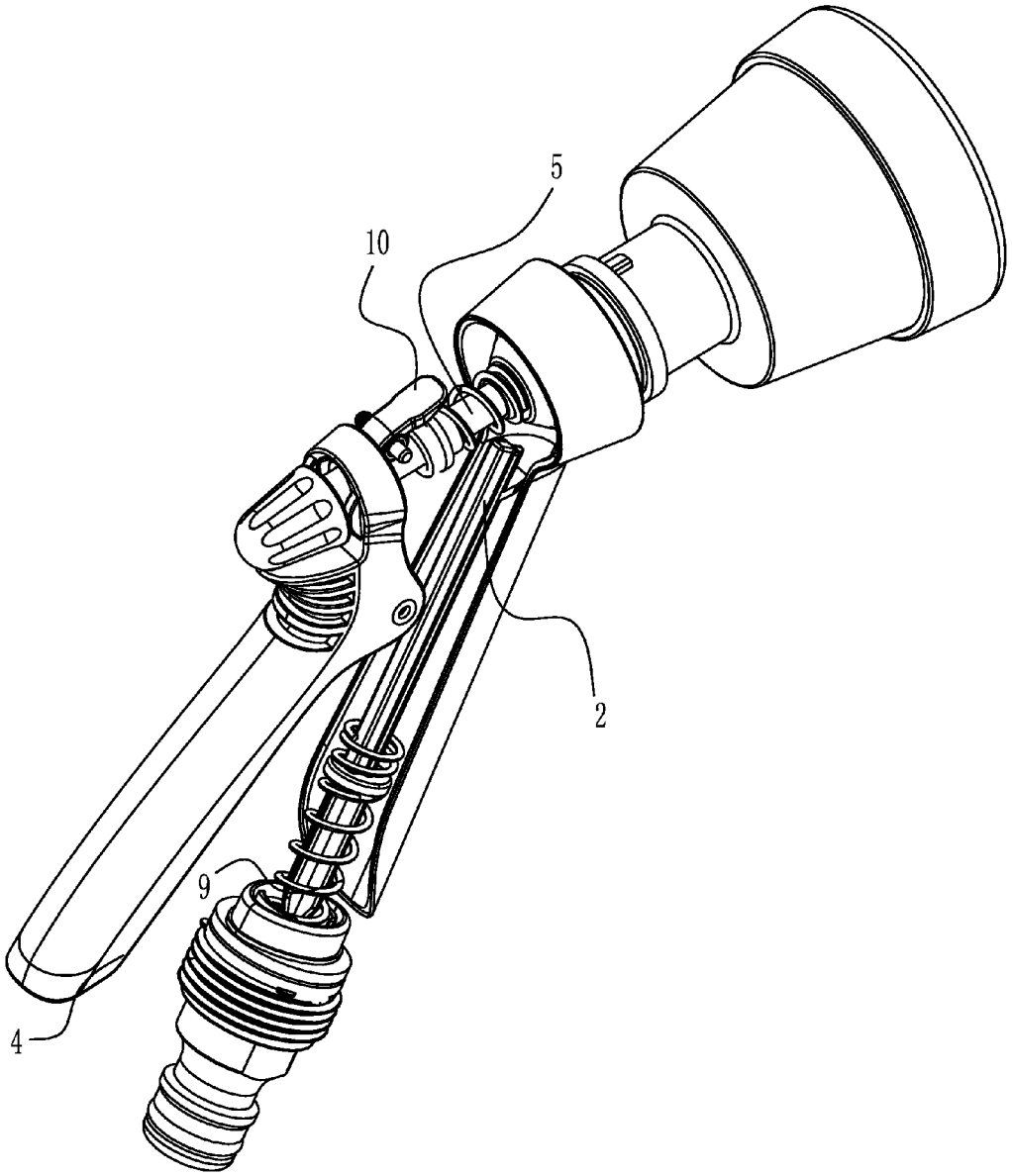
FIG. 5 is a stereogram of an inner part of an anti-freezing water spray gun having a water sealing position at a distal end with an outer casing being removed.
Figure 6:
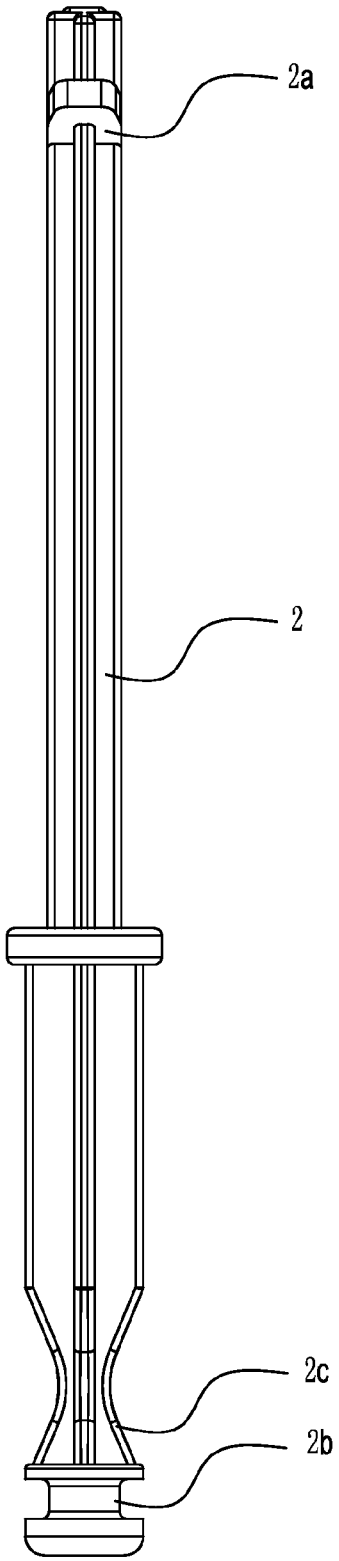
FIG. 6 is a front view of an water stop plug of a distal end.
Figure 7:
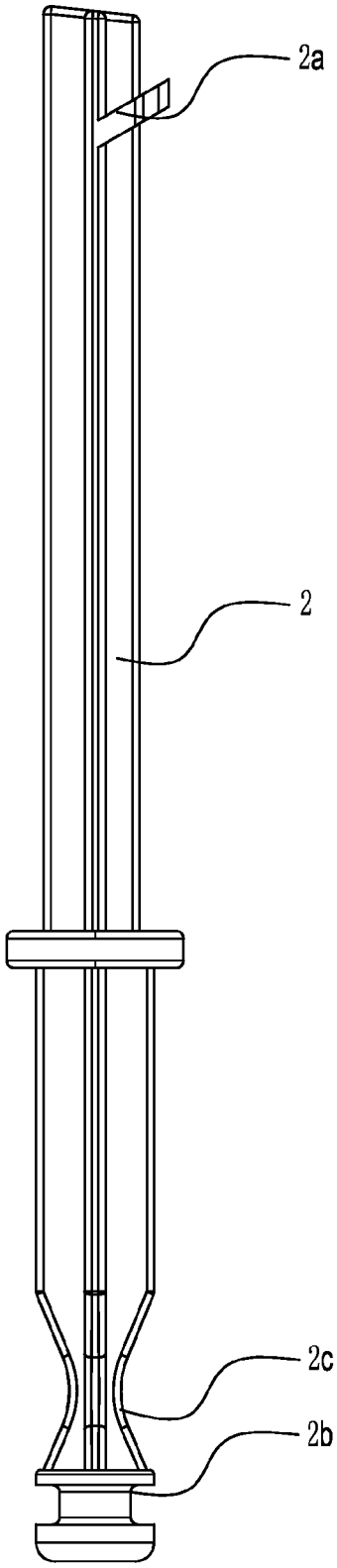
FIG. 7 is a left view of an water stop plug of a distal end.
Figure 8:
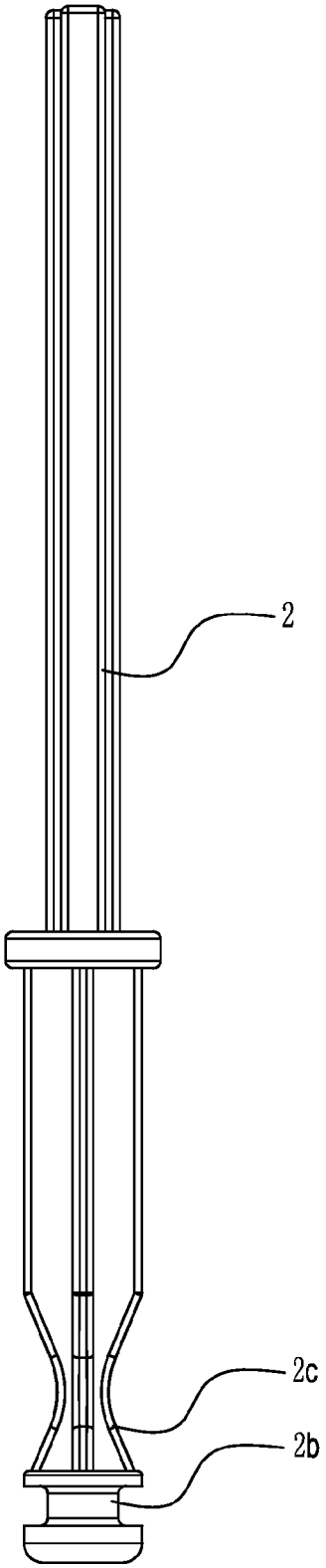
FIG. 8 is a rear view of an water stop plug of a distal end.
Figure 9:
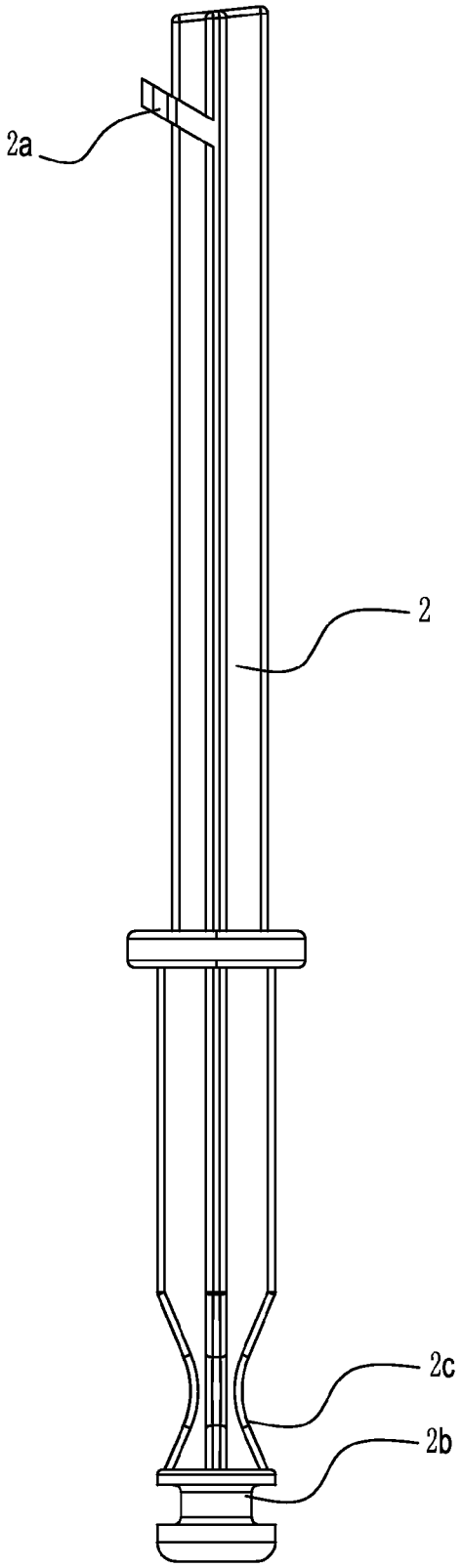
FIG. 9 is a right view of an water stop plug of a distal end.
Figure 10:
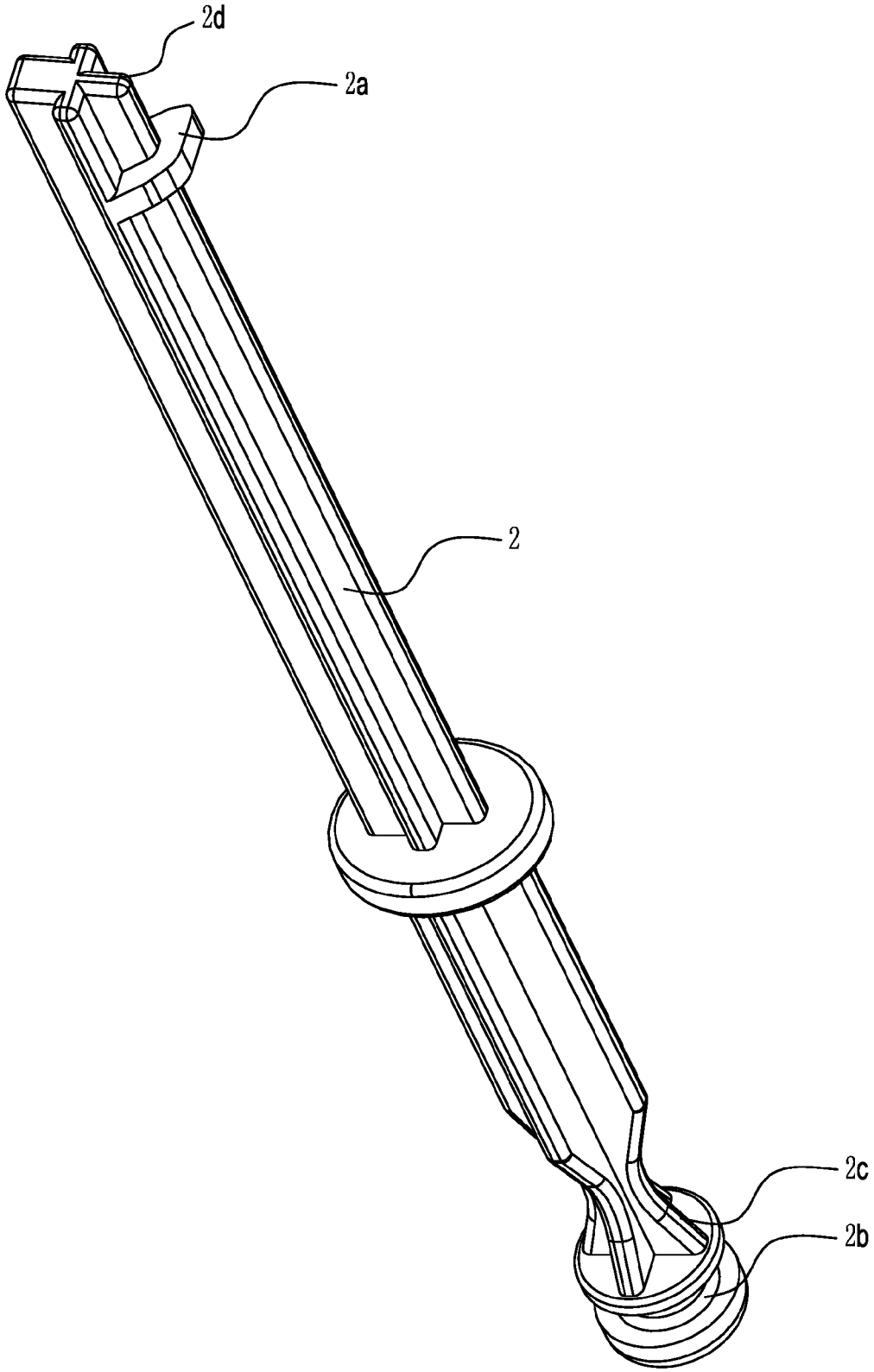
FIG. 10 is a first stereogram of an water stop plug of a distal end.
Figure 11:
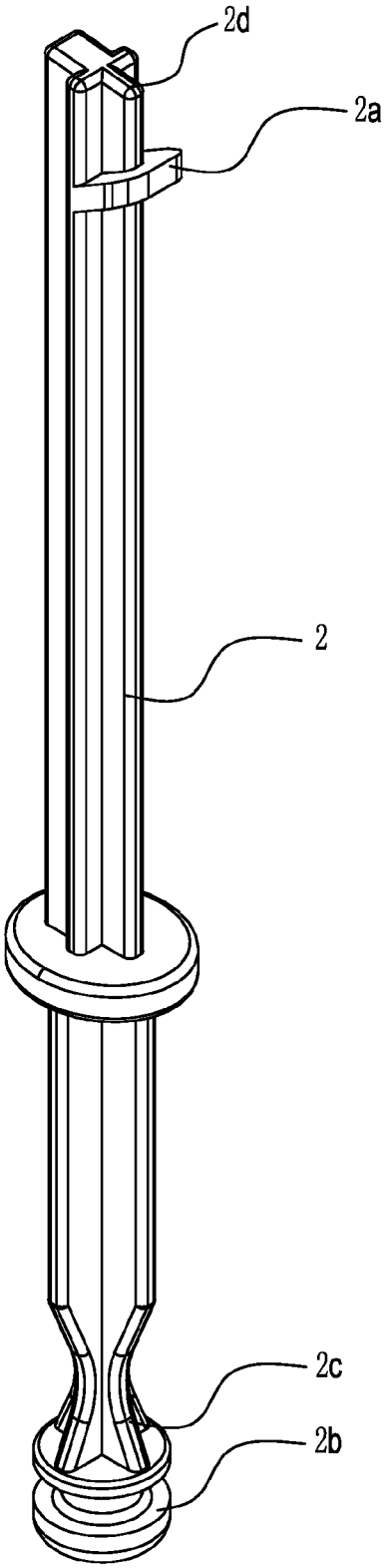
FIG. 11 is a second stereogram of an water stop plug of a distal end.
Figure 12:
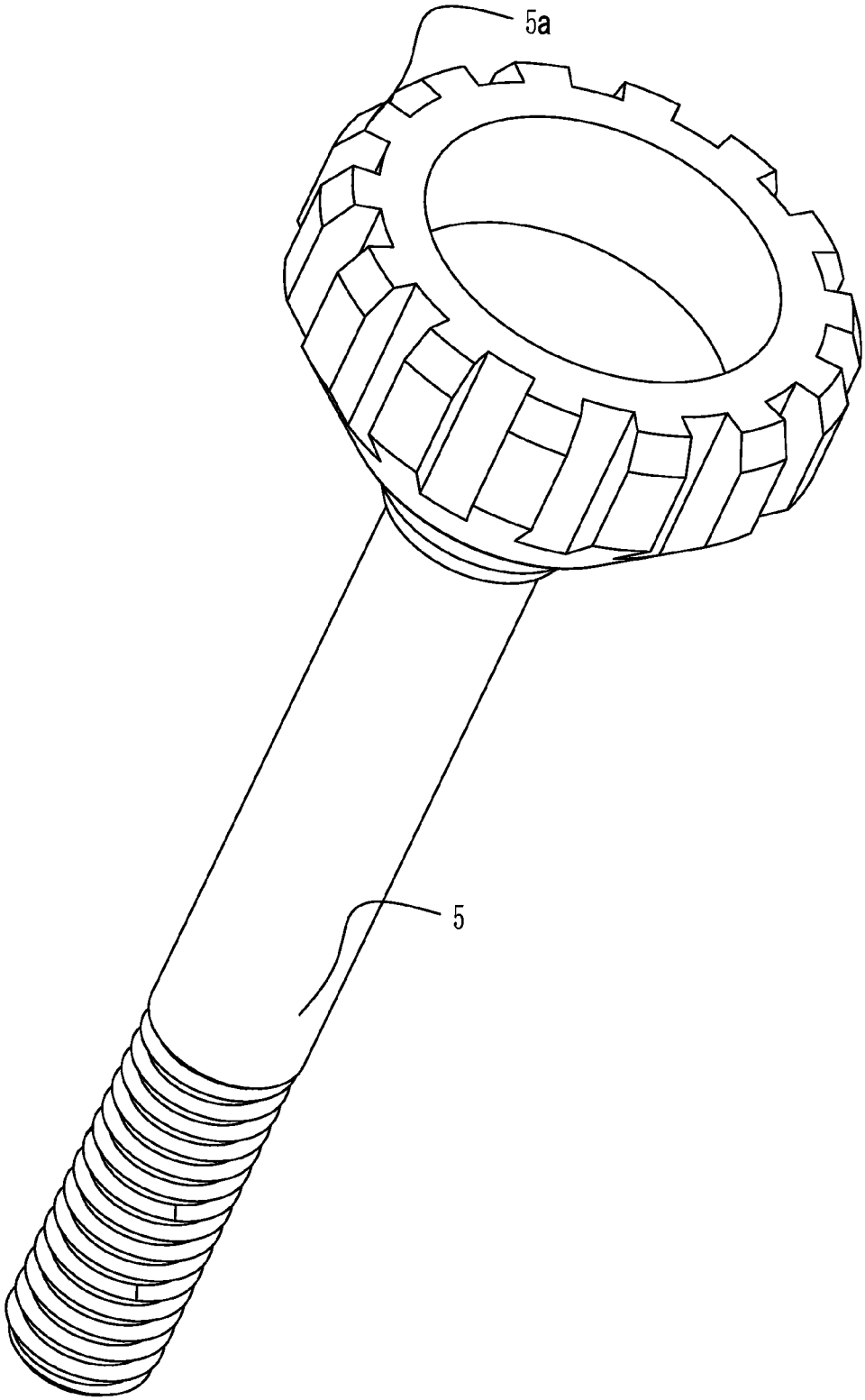
FIG. 12 is a first stereogram of a pull rod provided with a plug.
Figure 13:
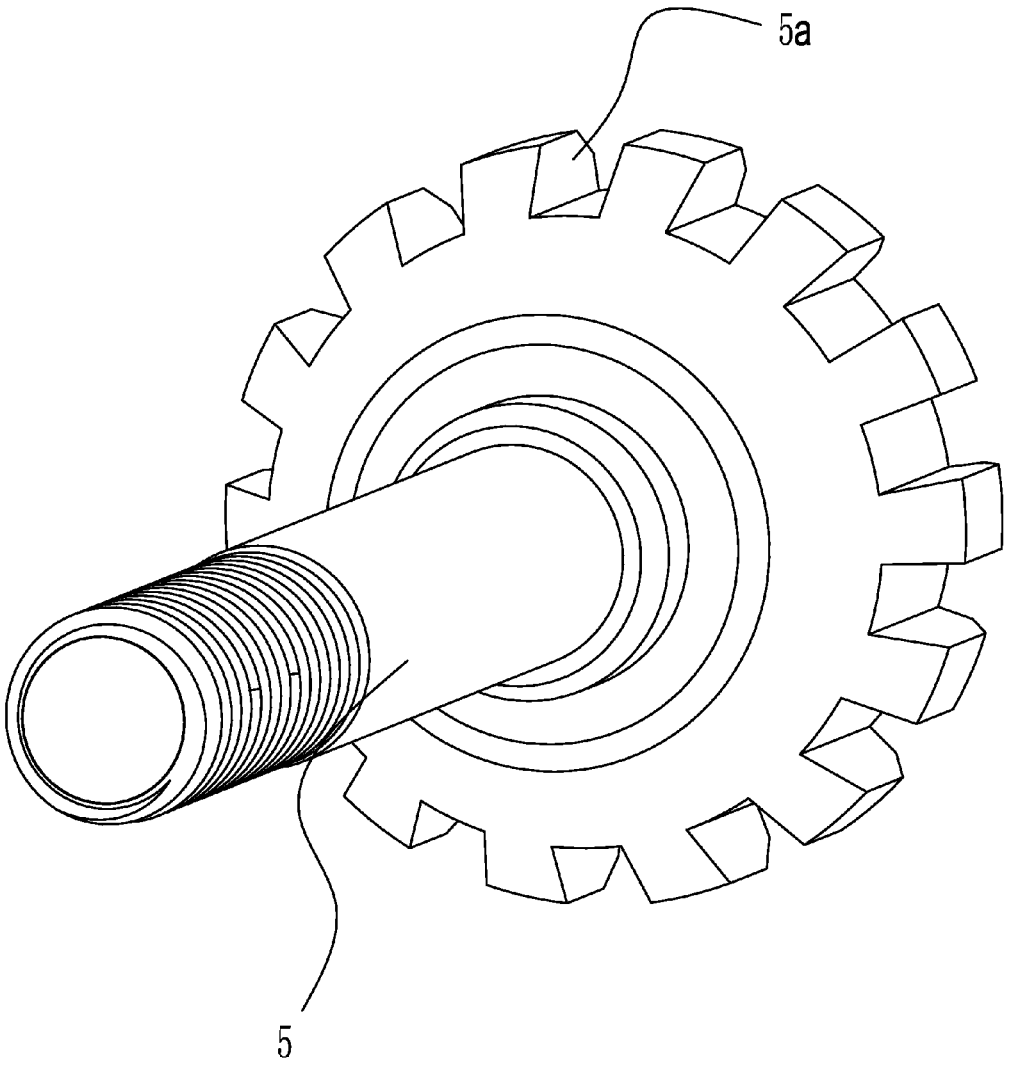
FIG. 13 is a second stereogram of a pull rod provided with a plug.
Figure 14:
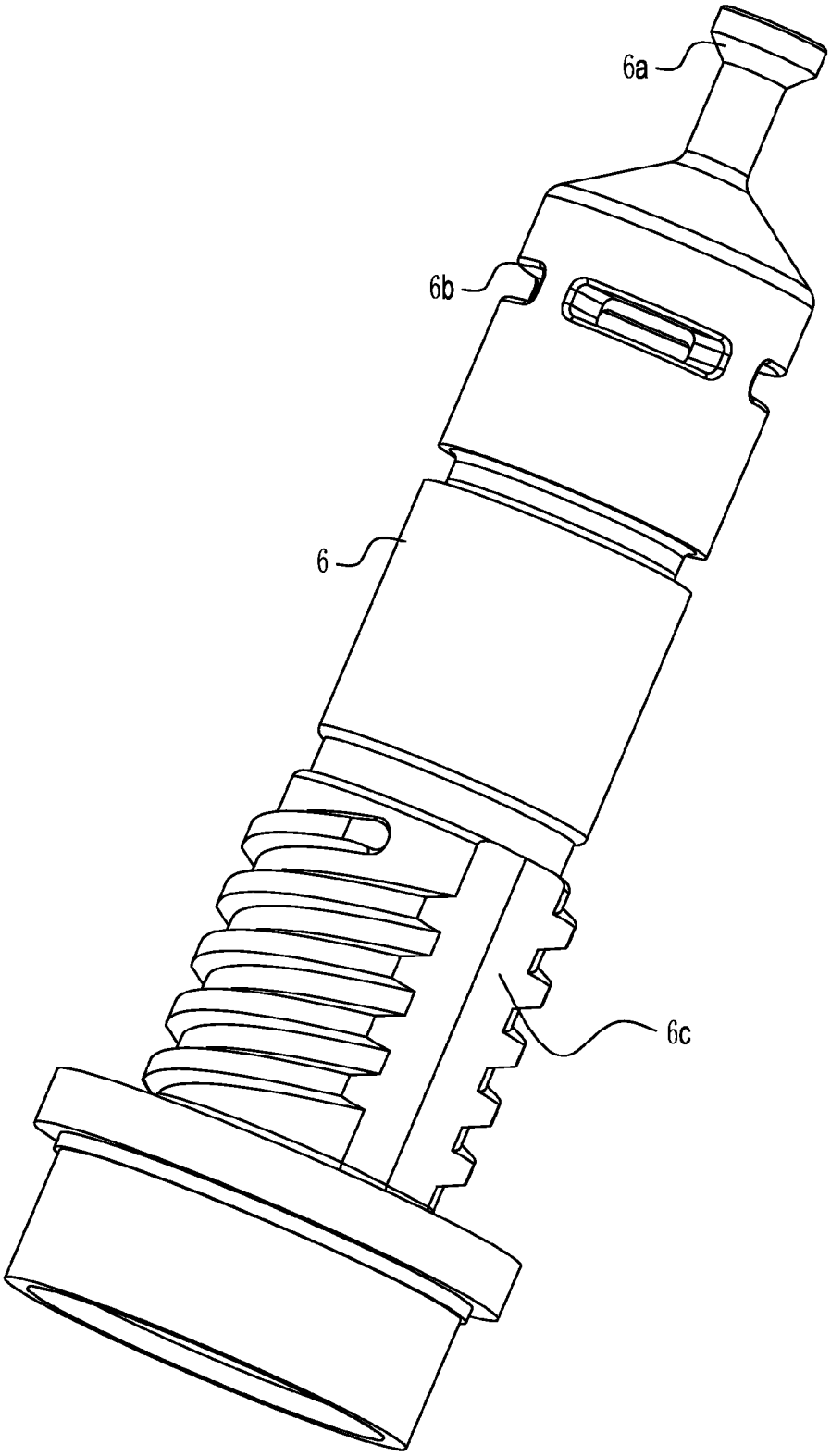
FIG. 14 is a stereogram of a spray bar.
Figure 15:
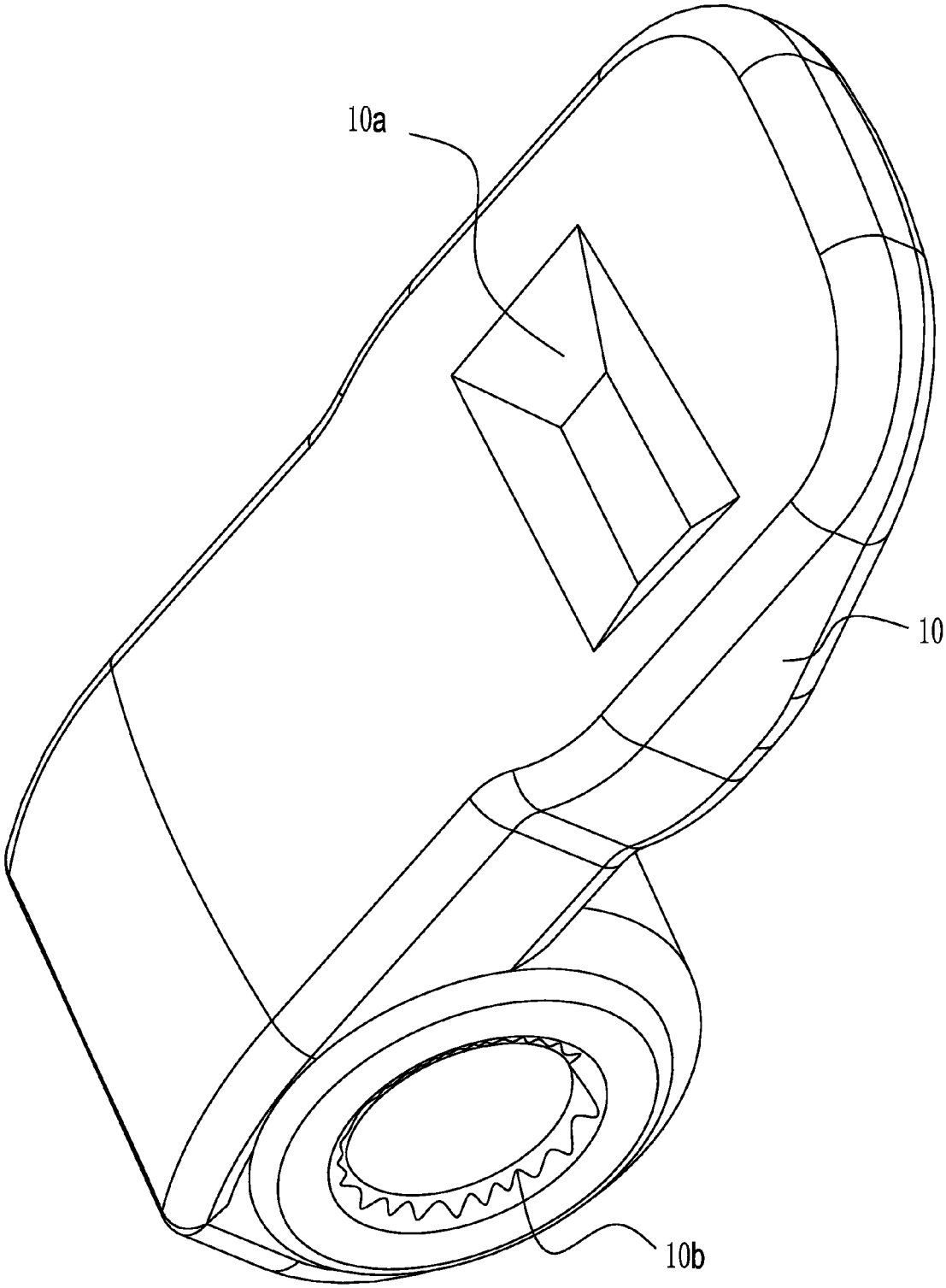
FIG. 15 is a stereogram of a lock button.
Figure 16:
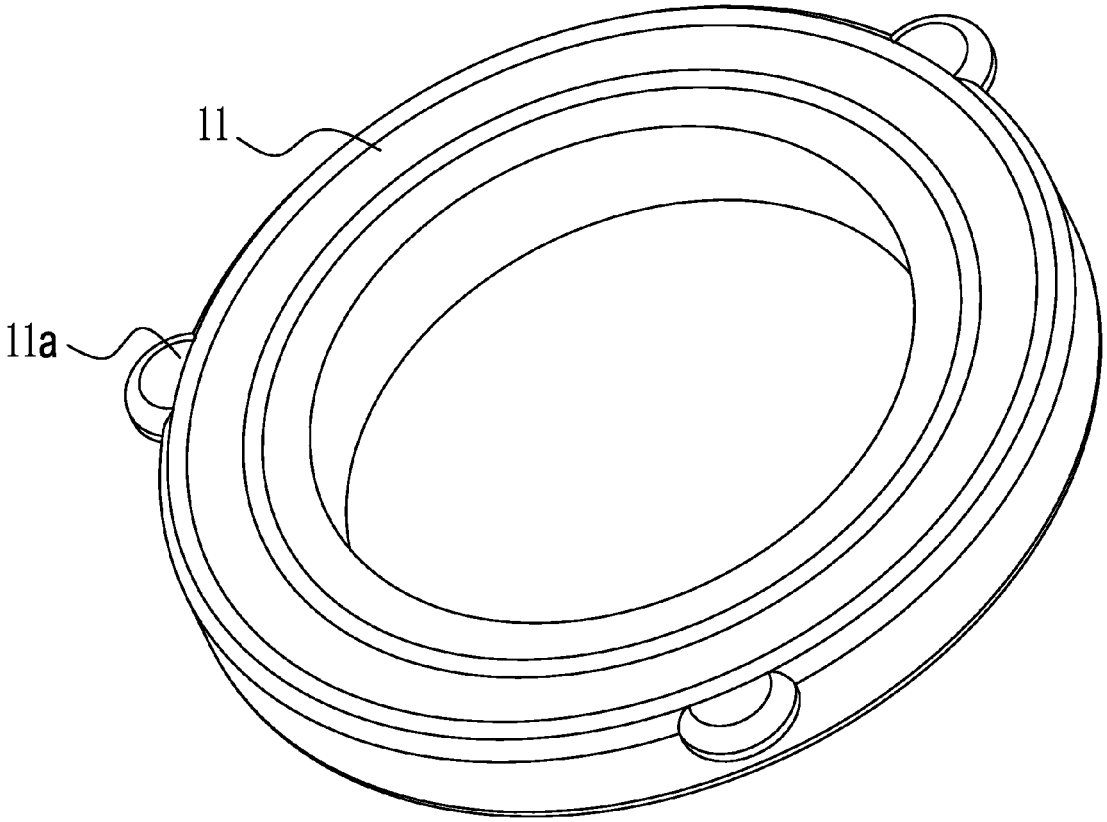
FIG. 16 is a stereogram of a second sealing ring for introducing water.
Figure 17:
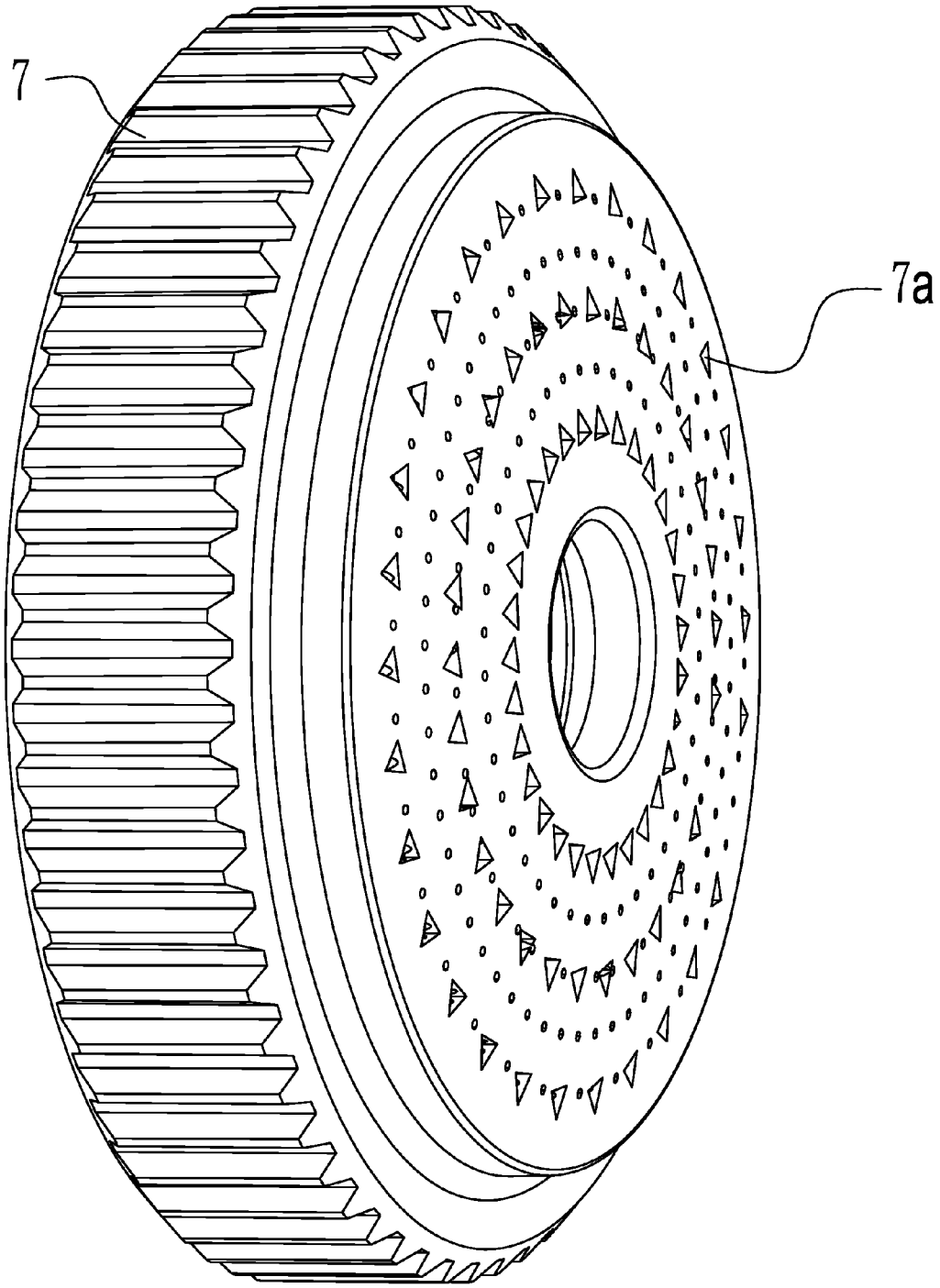
FIG. 17 is a stereogram of a water spray plate.
Figure 18:
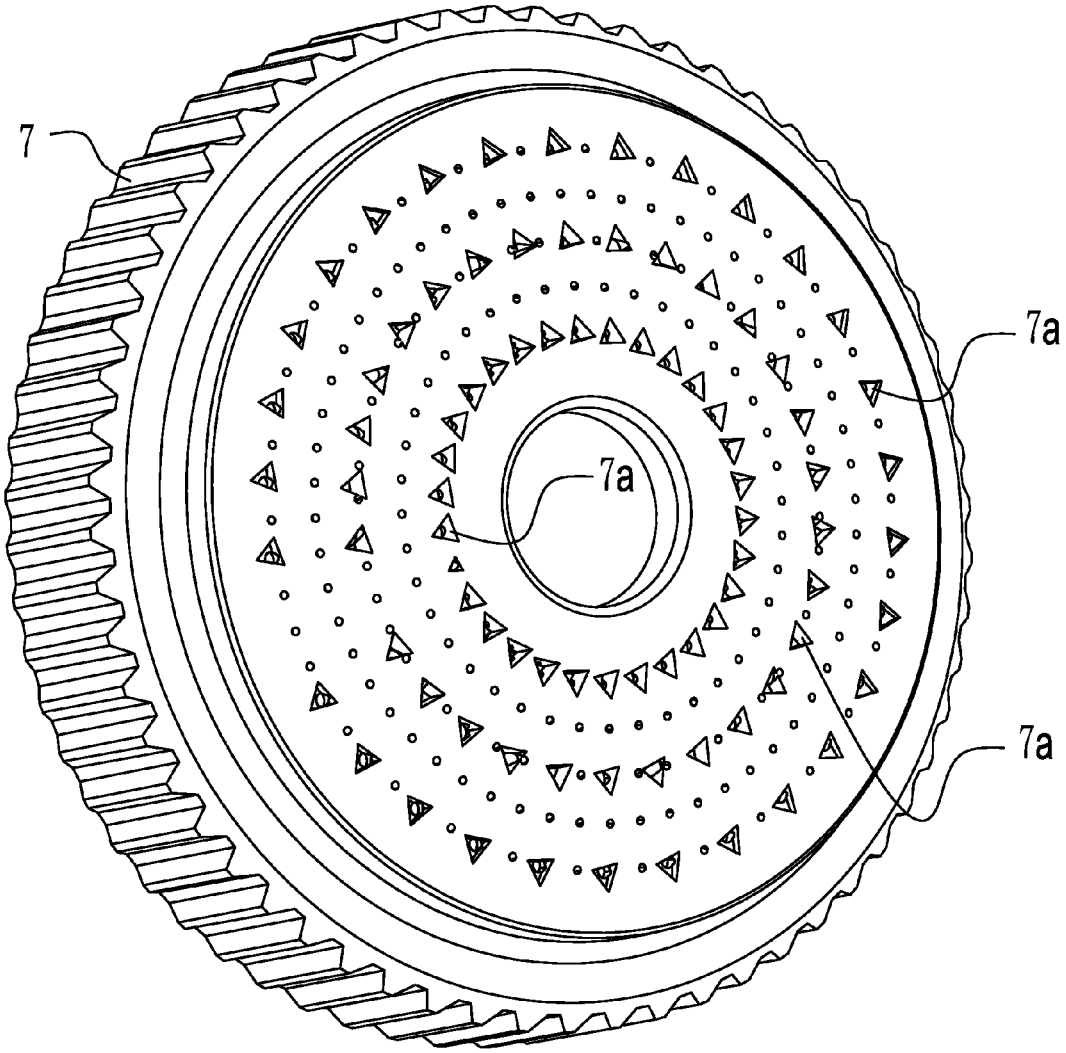
FIG. 18 is a front view of a water spray plate.
Figure 19:
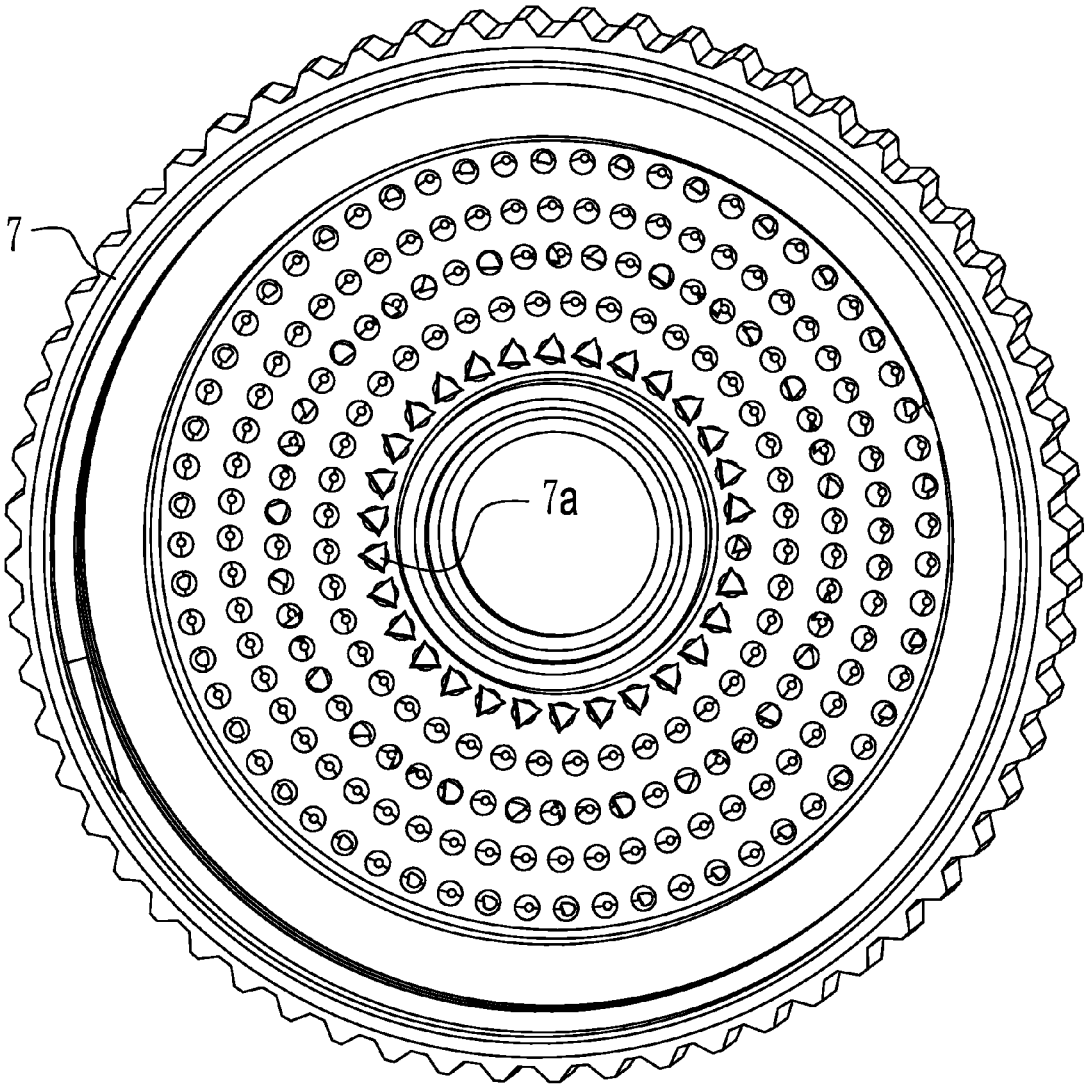
FIG. 19 is a rear view of a water spray plate.
Figure 20:
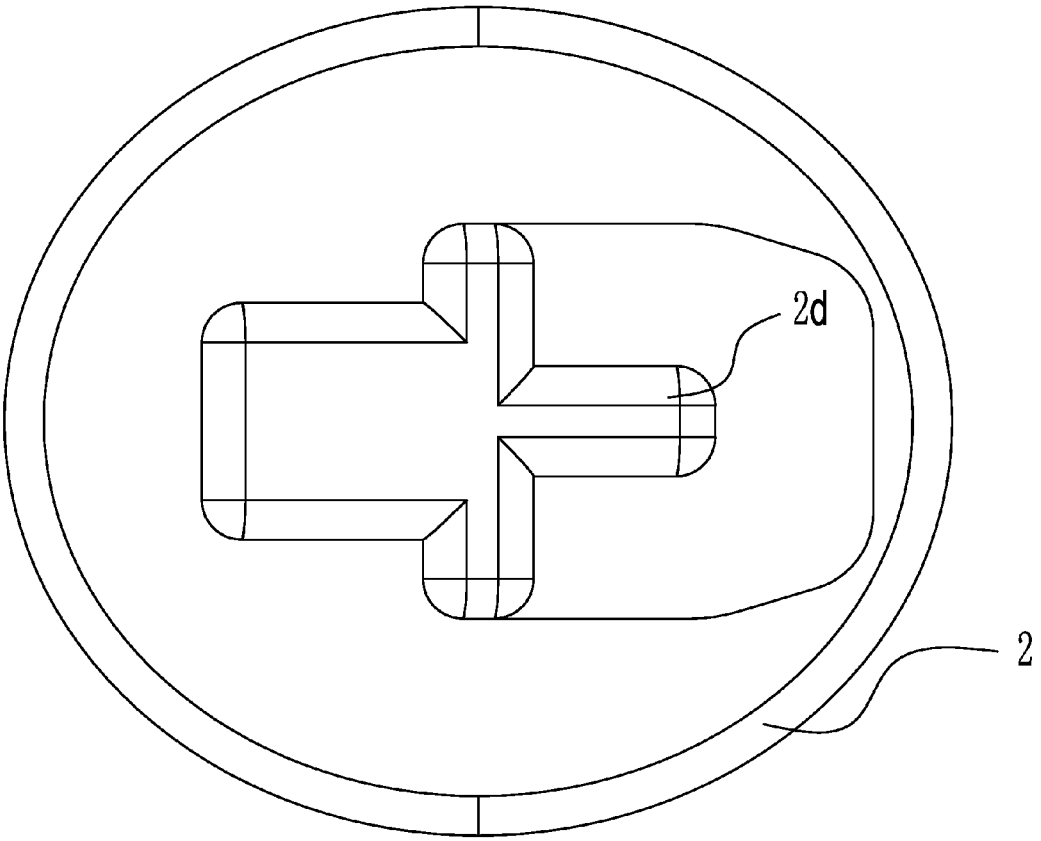
FIG. 20 is a top view of an water stop plug of a distal end.
Figure 21:
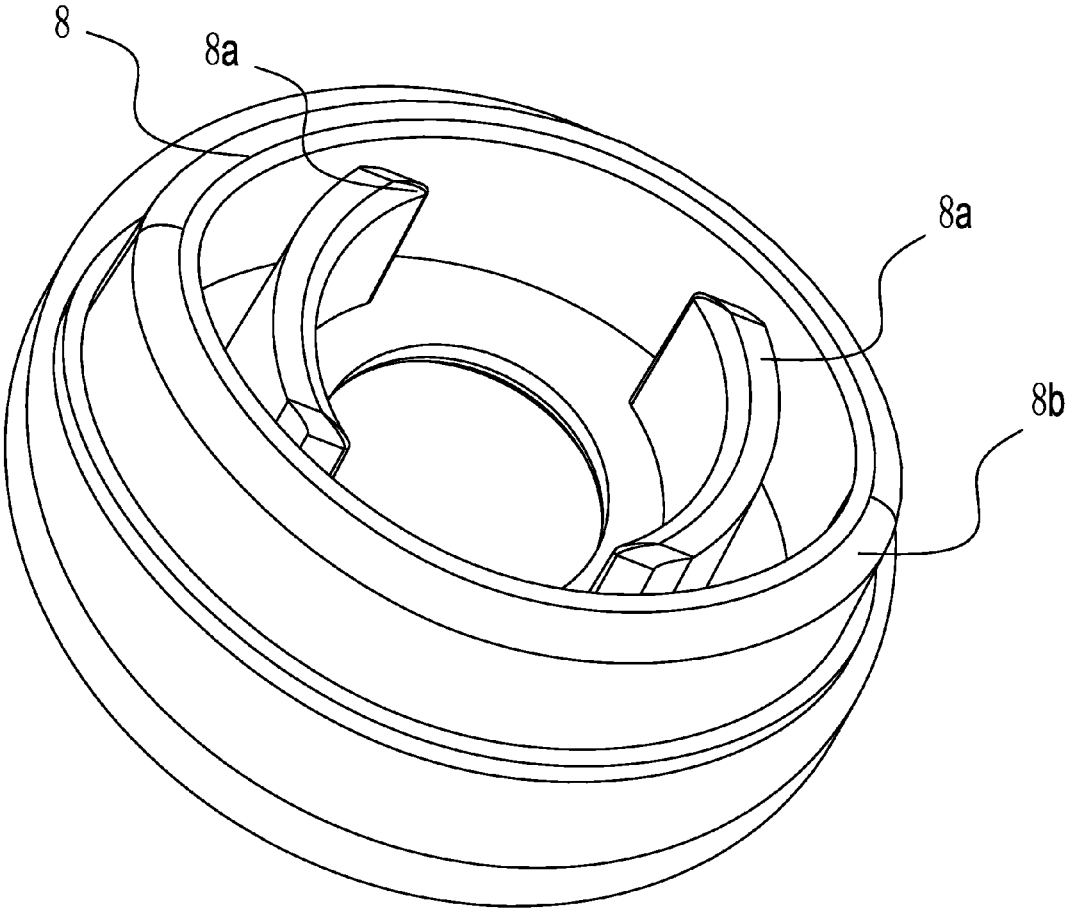
FIG. 21 is a stereogram of a water stop plate.

In the drawings, the following numbers are used: 1. First sealing ring for stopping water; 2. Water stop plug of a distal end; 2*a*. Oblique limiting piece; 2*b*. Seal groove; 2*c*. Deflection strips; 2*d*. Push head; 3. Gun body; 4. Handle; 5. Pull rod; 5*a*. Plug; 6. Spray bar; 6*a*. Spray head; 6*b*. Oblate nozzle; 6*c*. Guide surface; 7. Water spray plate; 7*a*. Triangular holes; 8. Water stop plate; 8*a*. Curved plates; 8*b*. Positioning ring; 9. Water stop spring; 10. Lock button; 10*a*. Recess; 10*b*. Convex-concave knurls; 11. Second sealing ring for introducing water; and 11*a*. Convex pieces.

DETAILED DESCRIPTION OF THE EMBODIMENTS

For further illustrating the invention, experiments detailing anti-freezing water spray gun having a water sealing position at a distal end are described hereinbelow combined with the drawings.

An anti-freezing water spray gun having a water sealing position at a distal end, comprises a gun body 3. The gun body comprises: an inner part, the inner part comprising a water channel; an outer part, the outer part comprising a handle 4; an upper part, the upper part comprising a spray bar 6, a water spray plate 7, a lock button 10, and a pull rod 5 comprising a plug; and a lower part, the lower part comprising an water stop plug 2 disposed at an distal end thereof, a water stop plate 8, a water stop spring 9, a first sealing ring 1 for stopping water, and a second sealing ring 11 for introducing water. The water channel is disposed in the inner part of the gun body 3. The handle 4 is movably mounted on the outer part of the gun body 3 via a pin. In conventional water spray gun, the water sealing position is disposed near the position of the plug, and water residues still remains in the gun body, which results freezing or even rupture of the gun body. However, the water spray gun of the invention is capable of sealing the water at a water sealing position of the distal end for keeping the water out of the gun body and for preventing the gun body from being frozen and ruptured after the water spray gun being closed. The pull rod is pulled backward when the handle is pressed down, the water stop plug moves downwardly under the force of the plug and drives the second sealing ring for introducing water to move outward to allow the water spray gun to stay at an open state. The water enters the gun body and is sprayed out via the spray bar 6 and the water spray plate 7. The handle is pressed by the lock button 10 for continuously spraying water. The pull rod is reset under the force of the spring when the handle is released and the water stop plug is reset under the force of the water stop spring 9, the first sealing ring for stopping water is driven to move forward, the water is sealed outside the gun body, and the water spray gun is at a closed state for keeping the water outside thereof. The plug and the water stop plug 2 of the distal end cooperate when the water spray gun is closed to allow the water stop plate 8 and the first sealing ring 1 to seal the water at the distal end for keeping the water out of the gun body and preventing the gun body from being frozen and ruptured.

The pull rod 5 comprises the plug 5*a* in the shape of a cone. The plug 5*a* comprises: a front circle comprising a plurality of teeth for allowing the water to flow out, and a conical head being connected to the pull rod 5. A generating line of a curved surface of the cone of the plug 5*a* is an equiangular spiral featuring in equivalent pressure angles, that is, logarithmic spiral. An equiangular spiral surface of the plug 5*a* is capable of stably matching with a push head 2*d* arranged on an upper part of the water stop plug 2 of the distal end.

In the above technical solution, the generating line of the curved surface of the cone of the plug 5*a* is the equiangular spiral featuring in equivalent pressure angles, that is, the logarithmic spiral. A section of a main body of the pull rod is selected, and a differential equation $d\rho/d\theta=k\rho$ is constructed as follows: a polar coordinates equation $\rho=\rho(\theta)$ is defined, as the pressure angle $\lambda$ is desired to be equivalent everywhere, $tg\lambda$ is evaluated with a constant value, and herein $tg\lambda=k$. According to the equation of the pressure angle $tg\lambda=\rho'/\rho$, $\rho'/\rho=k$ is derived. A differential equation $d\rho/d\theta=k\rho$ is derived by differential calculus.

To solve the differential equation $d\rho/d\theta=k\rho$, the variables are separated and integral calculus are performed on both sides of the equation: $\int d\rho/\rho=\int k d\theta$, since $\rho>0$, $\ln \rho=k\theta+C$ is obtained, that is, an exponential equation is $\rho=Ae^{k\theta+C}=e^{C}$, and $e^{k\theta}=Ae^{k\theta}$.

Drawing software PRO/ENGINEER WILDFIRE is adopted. A new working directory is started, and new components are constructed.

PARAMETER 1 is constructed: C is a real number and is a default assignment;

PARAMETER 2 is constructed: N is an integer and is a default assignment; and

Relations are constructed, and the equations of the invention are as follows: a logarithmic curve: z=0; x=10*t; and y=log(10*t+0.0001). The logarithmic curve is then drawn.

After that, a model is constructed by using instructions comprising revolution, merger, and materialization, and by performing work piece assembly and combination.

The equations and the model constructed by PRO/ENGINEER WILDFIRE are input into a CNC machining center, CIMATRO or MASTCAM are used to press a steel model for casting aluminum alloy, or a milling machine, facing machine, are an electric spark machining are used auxiliarily. When the electric spark machining is used, the equations are input into the CNC machining center. A tungsten copper electrode is required to be prepared, an ideal machine used herein is provided with three-dimensional rotating heads, for example, a Charmilles machine made in Sweden is preferred. After that, a cold chamber die casting machine or a hot chamber die casting machine is used for batch production, followed with machine work. Most workpiece are made of ZL109 or AC8A aluminum alloy and are polished. As the generating line of the curved surface of the cone of the plug 5*a* is a part of the equiangular spiral featuring in equivalent pressure angles, that is, the logarithmic spiral, the equiangular spiral surface of the plug 5*a* is capable of stably matching with the push head 2*d* arranged on the upper part of the water stop plug 2 of the distal end.

A seal groove 2*b* is disposed at a lower part of the water stop plug 2 of the distal end for fitting with the first sealing ring 1.

Four deflection strips 2*c* are arranged at a lower part of the water stop plug 2 of the distal end and uniformly surround an axis of a reciprocating direction of the water stop plug 2. A curve line of each of the four deflection strips 2*c* is a deflection curve satisfying a deflection curve equation concerning a load density q and a bending stiffness EJ in mechanics of materials.

An oblique limiting piece 2*a* is arranged at an upper part of the water stop plug 2, an included angle between the oblique limiting piece 2*a* and an axis of a reciprocating direction of the upper part of the water stop plug 2 is between 30° and 80° for limiting a position thereof.

A push head 2*d* is arranged at an upper part of the water stop plug 2 for matching with the plug 5*a* of the pull rod 5.

Two curved plates 8*a* are symmetrically disposed inside the water stop plate 8 for matching with the water stop spring 9 and four deflection strips 2*c* arranged at a lower part of the water stop plug 2 of the distal end. A positioning ring 8*b* in the shape of an ellipse is disposed at an outer part of the water stop plate 8 for preventing rotation. Through holes are arranged in the water stop plate 8 for matching with the first sealing ring 1.

The lock button 10 is in movable rivet connection with the gun body for locking the handle 4 during water spraying. A rivet hole of the lock button 10 is provided with convex-concave knurls 10*b* for preventing looseness. The lock button 10 is provided with a recess 10*a* for preventing a finger from slipping from the lock button 10.

The water spray plate 7 is provided with a plurality of triangular holes 7*a*, each triangular hole is in the shape of a triangle. The triangular holes are arranged in three concentric circles, and conic holes are arranged among the concentric circles.

Three convex pieces 11*a* are disposed on an outer ring of the second sealing ring 11 for introducing water at different horizontal planes. The arrangement of the three convex pieces 11*a* is in accordance with a helicoidal surface of a water inlet thread for attenuating a twisted stress and ensuring a sealing property.

Advantages of the invention are as follows:

First, the lock button 10 is in movable rivet connection with the gun body for locking the handle 4 during water spraying. The rivet hole of the lock button 10 is provided with convex-concave knurls 10*b* for preventing looseness. The lock button 10 is provided with the recess 10*a* for preventing the finger from slipping from the lock button 10. Thus, the structure of the water spray gun of the invention is very convenient.

Second, when the handle is released, the pull rod is reset under the force of the spring and the water stop plug is reset under the force of the water stop spring 9, the first sealing ring for stopping water is driven to move forward, the water is sealed outside the gun body, and the water spray gun is at the closed state for keeping the water outside thereof. The plug and the water stop plug 2 of the distal end cooperate when the water spray gun is closed to allow the water stop plate 8 and the first sealing ring for stopping water to seal the water at the distal end for keeping the water out of the gun body and preventing the gun body from being frozen and ruptured. The plug 5*a* comprises: the front circle comprising the teeth for allowing the water to flow out, and the conical head being connected to the pull rod 5. The generating line of the curved surface of the cone of the plug 5*a* is the equiangular spiral featuring in equivalent pressure angles, that is, logarithmic spiral. Thus, the equiangular spiral surface of the plug 5*a* stably matches with the push head 2*d* arranged on the upper part of the water stop plug 2 of the distal end. The water spray gun of the invention solves the problem in conventional water spray guns that the water sealing position is disposed near the plug and water residue remains in the gun body when the water spray gun is closed, which easily results in freezing and rupture of the water spray gun.

Third, the water spray plate 7 is provided with the triangular holes 7*a* arranged in three concentric circles, and conic holes are arranged among the concentric circles. The spray bar 6 comprises a guide surface 6*c* and oblate nozzles 6*b*. In spraying the water, the spray bar 6 slightly trembles under the combined force of the guide surface 6*c*, the plug, and the water jet. The water is ejected from the spray bar 6 via the oblate nozzles arranged on the spray bar 6, and is sprayed out via the spray head 6*a* of the spray bar and the triangular holes and the conic holes arranged on the spray plate, so that the pattern of the sprayed water is diversified.

Fourth, the conventional second sealing ring for introducing water is made of rubber and generally comprises three convex pieces arranged in the common horizontal plane, however, as the workpiece mounted thereon is provided with threads having a pitch, a helix angle, and a lead, so that when the conventional second sealing ring for introducing water comprising three convex pieces arranged on the common horizontal plane is mounted on the thread, the twisted internal stress is produced, thereby affecting the sealing property of the inner ring of the sealing ring. To solve the problem, the three convex pieces of the invention is arranged in accordance with the pitch of the thread. For example, if the pitch is equal to 1.5, then the height of each convex piece is increased by 0.5. As the three convex pieces of the outer ring of the second sealing ring 11 for introducing water are distributed at different heights according to the water inlet thread, the twisted stress is decreased and the sealing property is ensured.

In summary, first, the arrangement of the convex-concave knurl on the rivet hole of the lock button 10 is designed for the purpose of antislipping; the recess is disposed on the lock button, so that even the wet finger is capable of holding the lock button. Second, compared with the conventional water spray gun that easily causes freezing and rupture of the gun body since water residue remains therein when the water spray gun is closed, the water spray gun of the invention effectively overcomes such problem. When the handle of the water spray gun is released, the pull rod is reset, the first sealing ring for stopping water is driven to move forward since equiangular spiral surface of the plug 5*a* stably matches with a push head 2*d* of the water stop plug 2 of the distal end. The water is prevented out of the gun body, and the water spray gun is at the closed state for keeping the water outside thereof. Third, the water spray plate 7 is provided with triangular holes, thereby forming diversified patterns of the sprayed water. Fourth, the convex pieces of the outer ring of the first sealing ring for stopping water have proper pitch, helix angle, and lead for preventing the twisted internal stress.

The invention claimed is:

1. A water spray gun, comprising a gun body, the gun body comprising:

a) an inner part, the inner part comprising a water channel;

b) an outer part, the outer part comprising a handle;

c) an upper part, the upper part comprising a spray bar, a water spray plate, a lock button, and a pull rod comprising a plug; and d) a lower part, the lower part comprising a water stop plug disposed at an distal end thereof, a water stop plate, a water stop spring, a first sealing ring for stopping water, and a second sealing ring for introducing water;

wherein the water channel is disposed in the inner part of the gun body;

the handle is movably mounted on the outer part of the gun body via a pin;

when the handle is pressed down, the pull rod is pulled backward and the water stop plug moves downwardly under the force of the plug and drives the second sealing ring for introducing water to move outward to allow the water spray gun to stay at an open state; the water enters the gun body and is sprayed out via the spray bar and the water spray plate; the handle is pressed by the lock button to allow water to spray continuously; and when the handle is released, the pull rod is reset under a spring force and the water stop plug is reset under the force of the water stop spring, the first sealing ring for stopping water is driven to move forward, the water is sealed outside the gun body, and the water spray gun is at a closed state for keeping the water outside; when the water spray gun is closed, the plug cooperates with the water stop plug of the distal end to allow the water stop plate and the first sealing ring for stopping water to seal the water at the distal end for keeping the water out of the gun body thereby preventing the gun body from becoming stuck or rupturing.

2. The water spray gun of claim 1, wherein the plug of the pull rod is in the shape of a cone;

the plug comprises: a front circle comprising a plurality of teeth for allowing the water to flow out, and a conical head being connected to the pull rod;

a generating line of a curved surface of the cone of the plug is an equiangular spiral featuring in equivalent pressure angles or logarithmic spiral; and an equiangular spiral surface of the plug is capable of stably matching with a push head arranged on an upper part of the water stop plug of the distal end.

3. The water spray gun of claim 1, wherein a seal groove is disposed at a lower part of the water stop plug of the distal end for fitting with the first sealing ring for stopping water.

4. The water spray gun of claim 1, wherein four deflection strips are arranged at a lower part of the water stop plug of the distal end and uniformly surround an axis of a reciprocating direction of the water stop plug; and a curve line of each of the four deflection strips is a deflection curve satisfying a deflection curve equation concerning a load density q and a bending stiffness EJ in mechanics of materials.

5. The water spray gun of claim 1, wherein an oblique limiting piece is arranged at an upper part of the water stop plug, and an included angle between the oblique limiting piece and an axis of a reciprocating direction of the upper part of the water stop plug is between 30° and 80° for limiting a position thereof.

6. The water spray gun of claim 1, wherein a push head is arranged at an upper part of the water stop plug for matching with the plug of the pull rod.

7. The water spray gun of claim 1, wherein two curved plates are symmetrically disposed inside the water stop plate for matching with the water stop spring and four deflection strips arranged at a lower part of the water stop plug of the distal end;

a positioning ring in the shape of an ellipse is disposed at an outer part of the water stop plate for preventing rotation; and through holes are arranged in the water stop plate for matching with the first sealing ring.

8. The water spray gun of claim 1, wherein the lock button is in movable rivet connection with the gun body for locking the handle during water spraying;

a rivet hole of the lock button is provided with convex-concave knurls for preventing looseness; and the lock button is provided with a recess for preventing a finger from slipping from the lock button.

9. The water spray gun of claim 1, wherein the water spray plate is provided with a plurality of triangular holes; and the triangular holes are arranged in three concentric circles, and conic holes are arranged among the concentric circles.

10. The water spray gun of claim 1, wherein three convex pieces are disposed on an outer ring of the second sealing ring at different horizontal planes;

the arrangement of the three convex pieces is in accordance with a helicoidal surface of a water inlet thread for decreasing a twisted stress and ensuring a sealing property.

* * * * *